US009475304B2

(12) United States Patent
Sugitani et al.

(10) Patent No.: US 9,475,304 B2
(45) Date of Patent: Oct. 25, 2016

(54) INKJET PRINTING DEVICE AND METHOD FOR REGULATING INK CIRCULATION

(71) Applicant: RISO KAGAKU CORPORATION, Tokyo (JP)

(72) Inventors: Hiroshi Sugitani, Ibaraki (JP); Asayo Shimoda, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/817,402

(22) Filed: Aug. 4, 2015

(65) Prior Publication Data

US 2016/0052259 A1 Feb. 25, 2016

(30) Foreign Application Priority Data

Aug. 21, 2014 (JP) ..... 2014-168226

(51) Int. Cl.

| | |
|---|---|
| ***B41J 2/18*** | (2006.01) |
| ***B41J 2/045*** | (2006.01) |
| ***B41J 2/175*** | (2006.01) |
| ***B41J 29/377*** | (2006.01) |

(52) U.S. Cl.

CPC ..... *B41J 2/18* (2013.01); *B41J 2/0454* (2013.01); *B41J 2/04531* (2013.01); *B41J 2/04563* (2013.01); *B41J 2/175* (2013.01); *B41J 2/17556* (2013.01); *B41J 2/17596* (2013.01); *B41J 29/377* (2013.01); *B41J 2202/08* (2013.01); *B41J 2202/12* (2013.01)

(58) Field of Classification Search

CPC ..... B41J 2/175; B41J 2/17509; B41J 2/18; B41J 2/19; B41J 2/04531; B41J 2/0454; B41J 2/04563; B41J 2/17596; B41J 2202/08; B41J 2202/12

USPC ..... 347/5, 6, 17, 85, 89, 92

See application file for complete search history.

(56) References Cited

U.S. PATENT DOCUMENTS

| | | | | |
|---|---|---|---|---|
| 8,550,580 | B2 * | 10/2013 | Shimoda | B41J 2/175 347/6 |
| 8,820,891 | B2 | 9/2014 | Bansyo | |
| 9,010,895 | B2 | 4/2015 | Nakamura | |
| 2008/0158307 | A1 | 7/2008 | Nitta et al. | |
| 2009/0174735 | A1 * | 7/2009 | Yamada | B41J 2/175 347/7 |
| 2011/0050793 | A1 * | 3/2011 | Kumagai | B41J 2/125 347/22 |

FOREIGN PATENT DOCUMENTS

| | | |
|---|---|---|
| JP | 2008-162262 | 7/2008 |

* cited by examiner

*Primary Examiner* — Justin Seo

(74) *Attorney, Agent, or Firm* — Greenblum & Bernstein P.L.C.

(57) ABSTRACT

An inkjet printing device includes a printer, including an inkjet head having a nozzle configured to eject ink, an ink tank configured to store the ink, a circulation path configured to circulate ink between the ink tank and the inkjet head, an ink pump configured to send the ink from the ink tank to the inkjet head in order to circulate ink and an ink temperature detector configured to detect an ink temperature, a pressure regulator configured to apply a negative pressure to the ink tank and to regulate a pressure in the ink tank and a controller configured to control the pressure regulator in accordance with the ink temperature in the printer to regulate the pressure in the ink tank and to regulate a driving rate of the ink pump.

4 Claims, 4 Drawing Sheets

INKJET PRINTING DEVICE AND METHOD FOR REGULATING INK CIRCULATION

BACKGROUND

1. Technical Field

The present invention relates to an ink circulation type inkjet printing device.

2. Related Art

There is known an ink circulation type inkjet printing device configured to eject ink from an inkjet head to perform printing while circulating ink (see, for example, Patent Document 1).

In addition, as an ink circulation system, there is known a system configured to set a nozzle pressure of the inkjet head appropriately so as to generate a negative pressure on the downstream side of the inkjet head and to pressure-feed ink to the inkjet head by an ink pump so as to circulate the ink. In this system, the ink is circulated in order to obtain a circulation flow rate which is necessary to obtain an effect of cooling a piezoelectric element and so forth.

[Patent Document 1] Japanese Patent Application Laid-Open Publication No. 2008-162262.

SUMMARY

The inkjet head generates heat by performing an operation of ejecting ink. Thereby, the temperature of the ink is increased and the viscosity of the ink is reduced.

In the above-mentioned ink circulation system, the negative pressure on the downstream side of the inkjet head is maintained constant regardless of the temperature of the ink. Therefore, in a case where the temperature of the ink is increased and the viscosity of the ink is reduced, it is necessary to increase an amount of ink to be fed to the inkjet head in order to maintain an appropriate nozzle pressure. Hence, there is a concern that a load on the ink pump may be increased, the circulation flow rate may be increased excessively and thereby a fluctuation in nozzle pressure may be increased. In addition, when the fluctuation in nozzle pressure is increased, it is feared that the ink may be ejected unstably and a printed image quality may be deteriorated.

The present invention has been made in view of the above problem. An object of the present invention is to provide an inkjet printing device that can suppress deterioration of the printed image quality while suppressing the load on the ink pump.

In order to attain the above-mentioned object, a first feature of the inkjet printing device according to one embodiment of the present invention is to include a printer, including an inkjet head having a nozzle configured to eject ink, an ink tank configured to store the ink, a circulation path configured to circulate ink between the ink tank and the inkjet head, an ink pump configured to send the ink from the ink tank to the inkjet head in order to circulate ink and an ink temperature detector configured to detect an ink temperature; a pressure regulator configured to apply a negative pressure to the ink tank and to regulate a pressure in the ink tank; and a controller configured to control the pressure regulator in accordance with the ink temperature in the printer to regulate the pressure in the ink tank and to regulate a driving rate of the ink pump.

A second feature of the inkjet printing device according to the embodiment of the present invention is to include the printer in plurality, wherein the pressure regulator is used in common among all of the printers, and the controller determines a set negative pressure on the basis of the ink temperature in the printer and determines a necessary circulation amount of ink according to the set negative pressure, the ink temperature and a specified nozzle pressure for each of the printers, and controls the pressure regulator to regulate the pressure in the ink tank of each of the printers to the set negative pressure and to drive the ink pump at the driving rate according to the set negative pressure, the ink temperature and the necessary circulation amount for each of the printers.

BRIEF DESCRIPTION OF DRAWINGS

The invention will now be described with reference to the accompanying drawings wherein.

DETAILED DESCRIPTION

Figure 1:
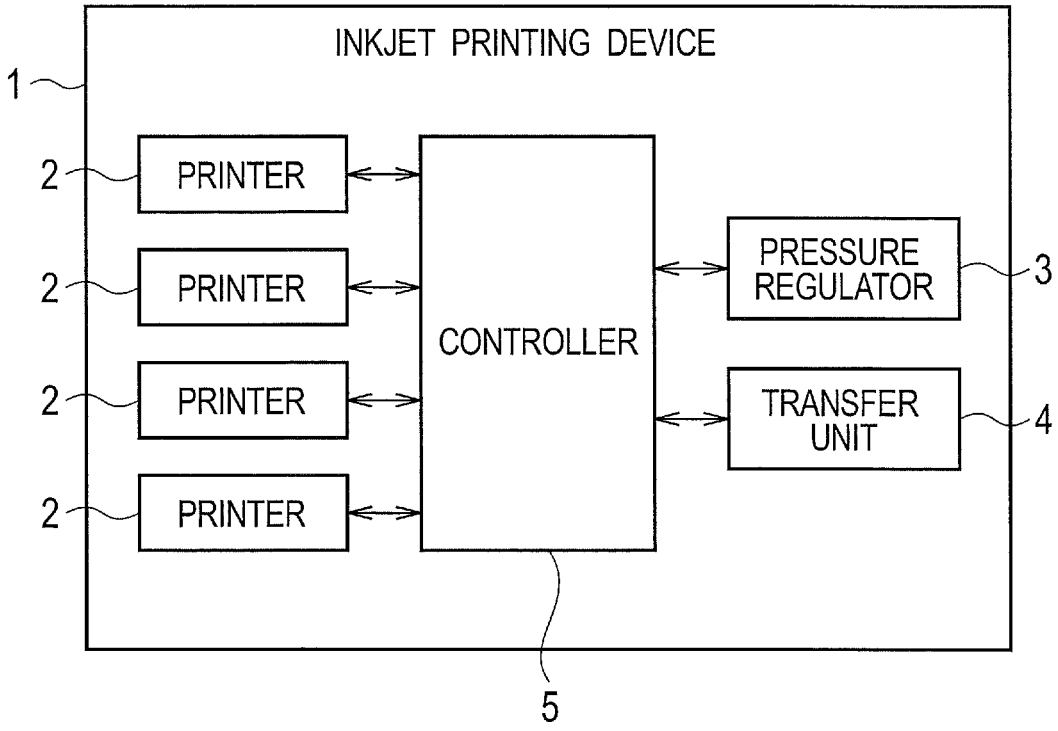
FIG. 1 is a block diagram illustrating a configuration of an inkjet printing device according to an embodiment.

An embodiment of the present invention will be described below with reference to the drawings. The same or equivalent numerals are assigned to the same or equivalent portions and constitutional elements in the drawings. However, it is to be noted that each drawing is merely schematic and is different from reality. In addition, it goes without saying that portions which are mutually different in mutual dimensional relation and ratio are included also among the drawings.

In addition, the embodiment which will be described in the following merely illustrates a device and so forth for embodying a technical idea of the present invention and the technical idea of the present invention does not specify a material quality, a shape, a structure, an arrangement and so forth of each constitutional component to ones which will be described below. The technical idea of the present invention may be modified in a variety of ways within a range of the scope of patent claims.

Figure 2:
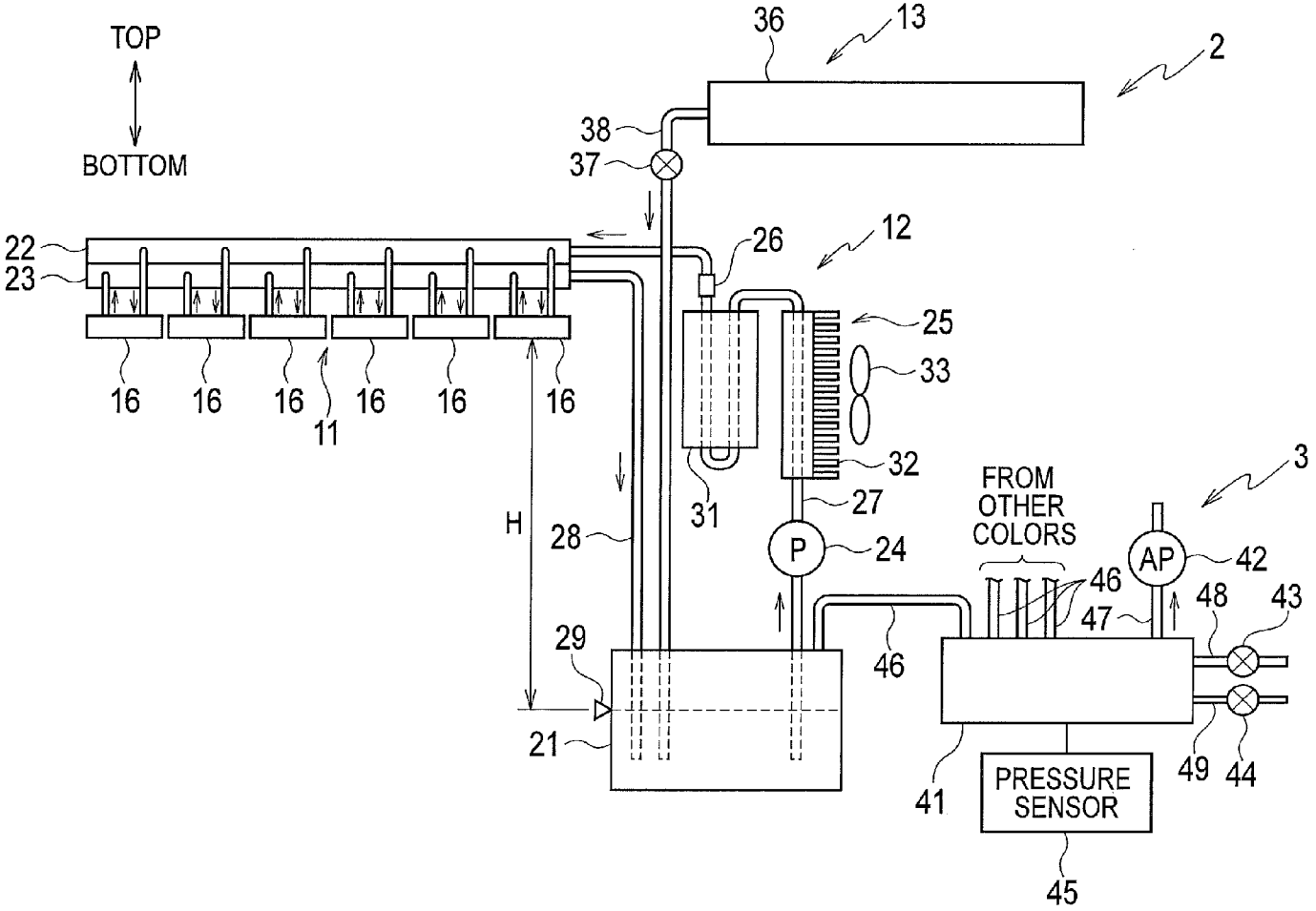
FIG. 2 is a schematic configuration diagram illustrating a printer and a pressure regulator of the inkjet printing device illustrated in FIG. 1.

FIG. 1 is a block diagram illustrating a configuration of an inkjet printing device according to one embodiment of the present invention. FIG. 2 is a schematic configuration diagram illustrating a printer and a pressure regulator of the inkjet printing device illustrated in FIG. 1. Incidentally, a top/bottom direction will be referred to as a vertical direction in the following description and a direction from top to bottom on a plane of paper in FIG. 2 will be referred to as the top/bottom direction.

As illustrated in FIG. 1, an inkjet printing device 1 according the present embodiment includes four printers 2, a pressure regulator 3, a transfer unit 4 and a controller 5.

The printer 2 ejects ink to a sheet which is transferred by the transfer unit 4 and prints an image on the sheet while circulating the ink. The four printers 2 eject ink of mutually different colors (for example, black (K), cyan (C), magenta (M) and yellow (Y)). The four printers 2 have the same configuration excepting that the colors of ink to be ejected are mutually different.

As illustrated in FIG. 2, the printer 2 includes an inkjet head 11, an ink circulation unit 12 and an ink replenishment unit 13.

The inkjet head 11 ejects the ink supplied from the ink circulation unit 12. The inkjet head 11 includes a plurality of head modules 16.

Each of the head modules 16 includes an ink chamber (not illustrated) which stores ink therein and a plurality of nozzles (not illustrated) through which ink is ejected. A piezoelectric element (not illustrated) is arranged in the ink chamber. The ink is ejected through the nozzle with drive of the piezoelectric element. The plurality of head modules 16 is arranged such that the heights of nozzle surfaces (lower surfaces) where the nozzles open are made the same as one another among all of the head modules 16.

The ink circulation unit 12 supplies ink to the inkjet head 11 while circulating the ink. The ink circulation unit 12 includes an ink tank 21, an ink distributor 22, an ink collector 23, an ink pump 24, an ink temperature regulator 25, an ink temperature sensor 26 (an ink temperature detector), and ink conduits 27, 28.

The ink tank 21 stores ink to be supplied to the inkjet head 11. Ink is replenished into the ink tank 21 from the ink replenishment unit 13. In addition, ink which has not been consumed in the inkjet head 11 is fed back to the ink tank 21 through the ink collector 23 and the ink conduit 28. An air layer is formed on a liquid surface of the ink in the ink tank 21. The ink tank 21 is arranged at a position lower than (below) the inkjet head 11.

The ink tank 21 includes a liquid surface sensor 29. The liquid surface sensor 29 is configured to detect whether or not the liquid surface height of ink in the ink tank 21 reaches a reference height. When the liquid surface height of the ink in the ink tank 21 is not less than the reference height, the liquid surface sensor 29 outputs a signal indicating "ON". While, when the liquid surface height of the ink is less than the reference height, the liquid surface sensor 29 outputs a signal indicating "OFF".

The ink distributor 22 distributes the ink supplied from the ink tank 21 to each head module 16 of the inkjet head 11 through the ink conduit 27.

The ink collector 23 collects the ink which has not been consumed in the inkjet head 11 from each head module 16. The ink which has been collected by the ink collector 23 flows into the ink tank 21 through the ink conduit 28.

The ink pump 24 feeds ink from the ink tank 21 to the inkjet head 11 in order to circulate the ink. The ink pump 24 is provided in the middle of the ink conduit 27.

The ink temperature regulator 25 regulates the temperature of the ink in the ink circulation unit 12. The ink temperature regulator 25 is provided in the middle of the ink conduit 27. The ink temperature regulator 25 includes a heater 31, a heat sink 32, and a cooling fan 33.

The heater 31 heats the ink in the ink conduit 27. The heat sink 32 cools the ink in the ink conduit 27 by heat radiation. The cooling fan 33 sends cooling air to the heat sink 32.

The ink temperature sensor 26 detects an ink temperature $T_i$ in the ink circulation unit 12. The ink temperature sensor 26 is provided in the middle of the ink conduit 27.

The ink conduit 27 connects the ink tank 21 with the ink distributor 22. Ink flows from the ink tank 21 toward the ink distributor 22 through the ink conduit 27. The ink conduit 28 connects the ink collector 23 with the ink tank 21. Ink flows from the ink collector 23 toward the ink tank 21 through the ink conduit 28. The ink conduits 27 and 28, the ink distributor 22 and the ink collector 23 form a circulation path through which ink is circulated between the ink tank 21 and the inkjet head 11.

The ink replenishment unit 13 replenishes ink into the ink circulation unit 12. The ink replenishment unit 13 includes an ink cartridge 36, an ink replenishment valve 37, and an ink conduit 38.

The ink cartridge 36 contains ink to be used for printing by the inkjet head 11. The ink in the ink cartridge 36 is supplied into the ink tank 21 of the ink circulation unit 12 through the ink conduit 38.

The ink replenishment valve 37 opens and closes an ink flow path in the ink conduit 38. When the ink is to be replenished into the ink tank 21, the ink replenishment valve 37 is opened.

The ink conduit 38 connects the ink cartridge 36 with the ink tank 21. Ink flows from the ink cartridge 36 toward the ink tank 21 through the ink conduit 38.

The pressure regulator 3 applies a negative pressure to the ink tank 21 and regulates a pressure in the ink tank 21. The pressure regulator 3 is configured to be used in common among all of the printers 2. The pressure regulator 3 includes a common air chamber 41, an air pump 42, an atmospheric air open valve 43, a pressure regulating valve 44, a pressure sensor 45, four air conduits 46, and air conduits 47, 48, 49.

The common air chamber 41 is a chamber configured to equalize the pressures in the ink tanks 21 of the respective printers 2. The common air chamber 41 communicates with air layers in the ink tanks 21 of the four printers 2 through the four air conduits 46. Thereby the ink tanks 21 of the respective printers 2 are brought into communication with one another through the common air chamber 41 and the air conduits 46.

The air pump 42 sucks air from the common air chamber 41 through the air conduit 47 and applies the negative pressure to the common air chamber 41 and the ink tank 21 of each of the printers 2. The air pump 42 is provided in the middle of the air conduit 47.

The atmospheric air open valve 43 opens and closes an air flow path in the air conduit 48 in order to switch a state of each of the common air chamber 41 and the ink tank 21 of each printer 2 between a sealed state (a state being shut off from the atmosphere) and an atmospheric air open state (a state leading to the atmosphere). The atmospheric air open valve 43 is provided in the middle of the air conduit 48.

The pressure regulating valve 44 opens and closes an air flow path in the air conduit 49 in order to regulate the pressures in the common air chamber 41 and the ink tank 21 of each of the printers 2. The pressure regulating valve 44 is provided in the middle of the air conduit 49.

The pressure sensor 45 detects the pressure in the common air chamber 41. The pressure in the common air chamber 41 is equal to the pressure in the ink tank 21 of each of the printers 2. This is because the common air chamber 41 communicates with the air layer in the ink tank 21 of each of the printers 2 through the air conduit 46.

The four air conduits 46 each connects the common air chamber 41 with the ink tank 21 of each of the four printers 2. The air conduit 46 is connected to the common air chamber 41 at one end and is connected to the air layer in the ink tank 21 at the other end.

The air conduit 48 forms an air flow path for opening the common air chamber 41 and the ink tanks 21 to the atmosphere. The air conduit 48 is connected to the common air chamber 41 at one end and leads to the atmosphere at the other end.

The air conduit 49 forms an air flow path for regulating pressures in the common air chamber 41 and the ink tanks 21. The air conduit 49 is configured by a pipe which is larger in flow path resistance than the air conduit 48. Specifically, the air conduit 49 is configured by the pipe which is thinner than the air conduit 48. The air conduit 49 is connected to the common air chamber 41 at one end and leads to the atmosphere at the other end.

The transfer unit 4 takes a sheet out of a paper feed tray (not illustrated) and transfers the sheet along a transfer path (not illustrated). The transfer unit 4 includes a roller (not illustrated) for transferring the sheet, a motor (not illustrated) for driving the roller and so forth.

The controller 5 controls an operation of each unit of the inkjet printing device 1. The controller 5 is configured by including a CPU, a RAM, a ROM, a hard disc and so forth.

The controller 5 regulates the pressure in each of the ink tanks 21 by the pressure regulator 3 in accordance with the ink temperature $T_i$ in each printer 2 and regulates a driving rate (a duty ratio) of the ink pump 24.

Specifically, the controller 5 determines a set negative pressure $P_f$ in the ink tank 21 on the basis of the ink temperature $T_i$ in each of the printers 2 and determines a necessary circulation flow rate $Q_n$ of ink according to the set negative pressure $P_f$, the ink temperature $T_i$, and a specified nozzle pressure $P_n$ for every printer 2. In addition, the controller 5 determines the driving rate of the ink pump 24 according to the set negative pressure $P_f$, the ink temperature $T_i$, and the necessary circulation flow rate $Q_n$ for every printer 2. Then, the controller 5 regulates the pressure in each of the ink tanks 21 to the set negative pressure $P_f$ by the pressure regulator 3 and drives the ink pump 24 at the driving rate which has been determined for every printer 2.

The controller 5 stores theoretical values of flow path resistances (flow path resistance/viscosity) per viscosity of ink for each of an upstream side flow path and a downstream side flow path in the ink circulation unit 12.

The upstream side flow path is an ink flow path configured by the ink conduit 27, the ink distributor 22, and a flow path between an input port and the nozzle of each head module 16 of the inkjet head 11. The downstream side flow path is an ink flow path configured by a flow path between the nozzle and an output port of each head module 16 of the inkjet head 11, the ink collector 23, and the ink conduit 28.

The flow path resistance is proportional to a viscosity μ of ink. The flow path resistance per viscosity is a proportional coefficient of the flow path resistance. The flow path resistance per viscosity is determined depending on the shape of the flow path concerned. The flow path resistance per viscosity is used for calculating a flow path resistance $R_u$ of the upstream side flow path and a flow path resistance $R_d$ of the downstream side flow path from the viscosity μ according to the ink temperature $T_i$. The flow path resistance $R_d$ of the downstream side flow path is used for calculating a later described standard negative pressure $P_t$ when determining the set negative pressure $P_f$. The flow path resistance $R_u$ of the upstream side flow path is used for calculating a load pressure P which is necessary to determine the driving rate of the ink pump 24.

The controller 5 stores a calculation formula used for obtaining the viscosity μ of ink from the ink temperature $T_i$ for ink of each color corresponding to each of the printers 2. The viscosity μ of ink is used for calculating the flow path resistance $R_u$ of the upstream side flow path and the flow path resistance $R_d$ of the downstream side flow path.

The controller 5 stores a calculation formula used for obtaining a density ρ of ink from the ink temperature $T_i$ for ink of each color. The density ρ of ink is used for calculating a later described standard negative pressure $P_t$ when determining the set negative pressure $P_f$. In addition, the density ρ of ink is used for calculating a later described necessary circulation flow rate $Q_n$ when determining the driving rate of the ink pump 24.

Figure 3:
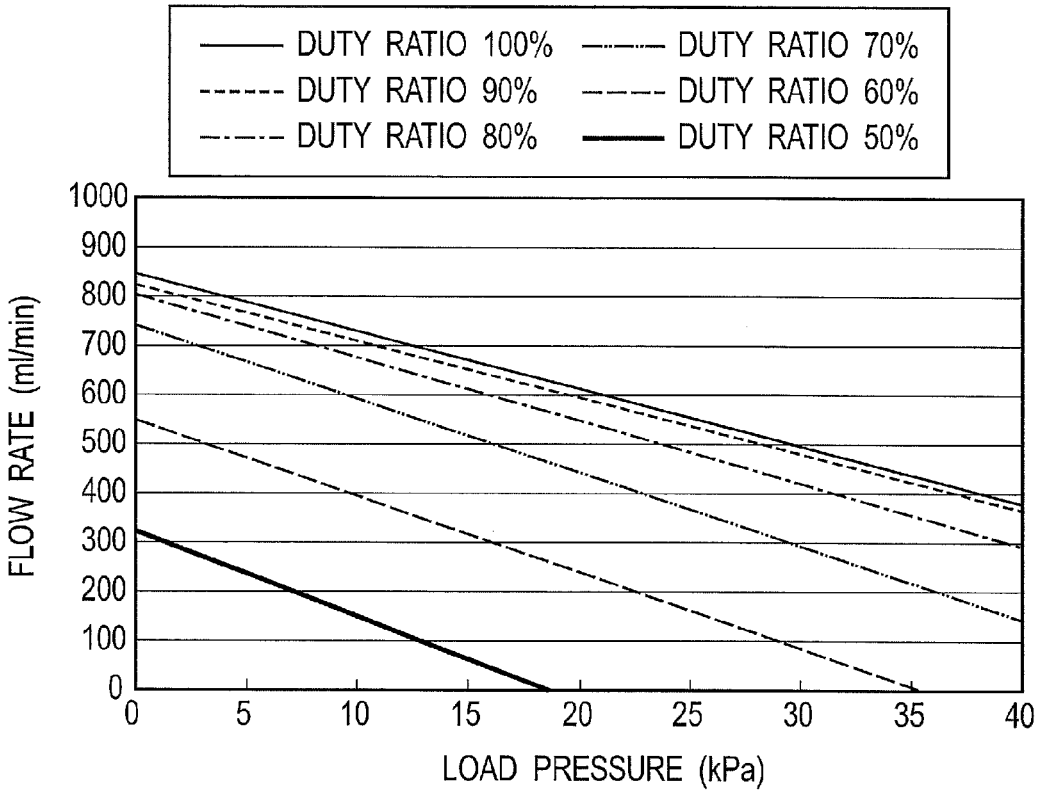
FIG. 3 is a diagram illustrating a liquid feeding characteristic of an ink pump.

The controller 5 stores a calculation formula used for obtaining the driving rate (the duty ratio) from the load pressure P and a flow rate Q of the ink pump 24. Here, the ink pump 24 has a liquid feeding characteristic (PQ characteristic) according to the driving rate, for example, as illustrated in FIG. 3. A calculation formula for the driving rate of the ink pump 24 is prepared so as to allow calculation of the driving rate from the load pressure P and the flow rate Q on the basis of the PQ characteristic as illustrated in FIG. 3. There are cases where there exists a plurality of the calculation formulae for the driving rate of the ink pump 24 in accordance with a range of the load pressure P.

Next, an operation of the inkjet printing device 1 will be described.

Figure 4:
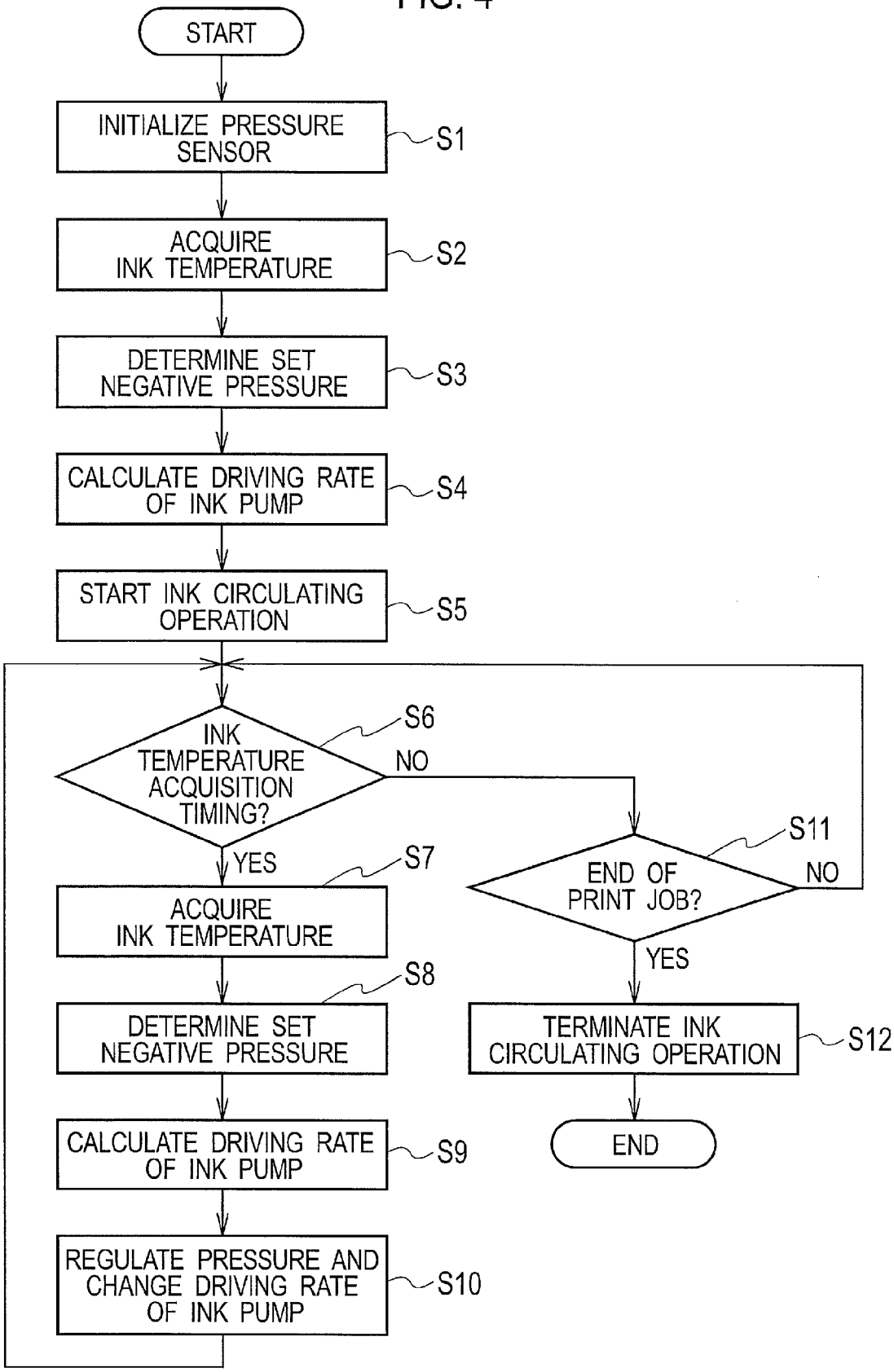
FIG. 4 is a flowchart for describing an operation of the inkjet printing device illustrated in FIG. 1.

FIG. 4 is a flowchart for describing the operation of the inkjet printing device 1. Processing in the flowchart in FIG. 4 is started by inputting a print job into the inkjet printing device 1.

In step S1 in FIG. 4, the controller 5 performs initialization of the pressure sensor 45.

Then, in step S2, the controller 5 acquires the ink temperature $T_i$ from the ink temperature sensor 26 of each printer 2.

Then, in step S3, the controller 5 determines the set negative pressure $P_f$ of the ink tank 21.

Specifically, first, the controller 5 calculates the standard negative pressure $P_t$ of the ink tank 21 at the current ink temperature $T_i$ in each of the printers 2. The standard negative pressure $P_t$ is calculated by the following Mathematical formula 1.

$$P_t = -Q_{min} \cdot R_d + P_n + H \cdot \rho \cdot g \qquad \text{[Mathematical formula 1]}$$

The standard negative pressure $P_t$ [unit: Pa] is a pressure of the ink tank 21 at which the nozzle pressure reaches the specified nozzle pressure $P_n$ [unit: Pa] at a circulation flow rate of a minimum required flow rate $Q_{min}$ [unit: $m^3/s$].

The minimum required flow rate $Q_{min}$ is a minimum circulation flow rate which is required to cool the piezoelectric element of the head module 16 of the inkjet head 11 and to wash away air bubbles and foreign materials (dust, viscosity-increased ink and so forth) which are present in the vicinity of the nozzle. The minimum required flow rate $Q_{min}$ has a fixed value which has been set in advance.

The specified nozzle pressure $P_n$ is set in advance as a nozzle pressure which is appropriate for ink ejection.

The flow path resistance $R_d$ [unit: $Pa \cdot s/m^3$] of the downstream side flow path is calculated from a theoretical value of a flow path resistance (flow path resistance/viscosity) per viscosity of the downstream side flow path and the viscosity μ [unit: Pa·s] of ink. The viscosity μ is calculated from the ink temperature $T_i$.

H [unit: m] is a difference in height (water head difference) between a nozzle surface (a lower surface) of the head module 16 of the inkjet head 11 and a liquid surface (a reference height) of the ink tank 21 as illustrated in FIG. 2.

The density ρ [unit: $kg/m^3$] of ink is calculated from the ink temperature $T_i$. g [unit: $m/s^2$] is a gravitational acceleration.

In Mathematical formula 1, the first term [$Q_{min} \cdot R_d$] expresses the magnitude of a pressure loss generated on the downstream side flow path relative to the minimum required flow rate $Q_{min}$ and the second term [H·ρ·g] expresses a water head pressure.

The controller 5 calculates the standard negative pressure $P_t$ according to the ink temperature $T_i$ in each printer 2 by using Mathematical formula 1 and then determines a minimum value (which is maximum in absolute value) in the values of the standard negative pressure $P_t$ of each printer 2 as the set negative pressure $P_f$.

Then, in step S4, the controller 5 calculates the driving rate of the ink pump 24 of each printer 2.

Specifically, first, the controller 5 calculates the necessary circulation flow rate $Q_n$ [unit: $m^3/s$] of ink according to the set negative pressure $P_f$, the ink temperature $T_i$ and the specified nozzle pressure $P_n$ in regard to each printer 2. The necessary circulation flow rate $Q_n$ is calculated by the following Mathematical formula 2.

$$Q_n = \frac{-P_f + P_n + H \cdot \rho \cdot g}{R_d} \quad \text{[Mathematical formula 2]}$$

The necessary circulation flow rate $Q_n$ is a circulation flow rate which is required to set the nozzle pressure to the specified nozzle pressure $P_n$ when the pressure of the ink tank 21 has been set to the set negative pressure $P_f$ at the current ink temperature $T_i$. Incidentally, in the printer 2 in which the standard negative pressure $P_t$ has been adopted as the set negative pressure $P_f$, the minimum required flow rate $Q_{min}$ is set as the necessary circulation flow rate $Q_n$.

Then, the controller 5 calculates the load pressure P [unit: Pa] of the ink pump 24 according to the set negative pressure $P_f$, the ink temperature $T_i$ and the necessary circulation flow rate $Q_n$ in regard to each printer 2. The load pressure P is calculated by the following Mathematical formula 3.

$$P = -P_f + Q_n \cdot R_u \quad \text{[Mathematical formula 3]}$$

Here, the flow path resistance $R_u$ [unit: $Pa \cdot s/m^3$] of the upstream side flow path is calculated from a theoretical value of the flow path resistance (flow path resistance/viscosity) per viscosity of the upstream side flow path and the viscosity μ according to the ink temperature $T_i$. In Mathematical formula 3, the second term $[Q_n \cdot R_u]$ indicates the magnitude of the pressure loss generated on the upstream side flow path relative to the necessary circulation flow rate $Q_n$.

Then, the controller 5 calculates the driving rate of the ink pump 24 according to the load pressure P and the necessary circulation flow rate $Q_n$ in each printer 2 by using the aforementioned calculation formula of the driving rate according to the PQ characteristic.

Then, in step S5, the controller 5 starts an ink circulating operation. Specifically, first, the controller 5 closes the atmospheric air open valve 43. Incidentally, in a standby mode that the inkjet printing device 1 does not perform the ink circulating operation, the atmospheric air open valve 43 is opened and the ink tank 21 is opened to the atmosphere. The pressure regulating valve 44 is kept closed since the inkjet printing device 1 is in the standby mode.

Then, the controller 5 starts driving of the air pump 42. The common air chamber 41 and the ink tank 21 are decompressed by driving of the air pump 42. The controller 5 controls to stop the air pump 42 when a detection value of the pressure sensor 45 reaches the set negative pressure $P_f$.

In addition, the controller 5 starts driving of the ink pump 24 of each printer 2, simultaneously with start of driving of the air pump 42. Here, the controller 5 drives the ink pump 24 of each printer 2 at the driving rate which has been calculated in step S4.

The negative pressure is applied to the ink tank 21 by the air pump 42 and the ink pump 24 is driven, and thereby the ink is circulated along the circulation path of the ink circulation unit 12.

While the ink circulating operation is being performed, the controller 5 executes a print job. Specifically, the controller 5 allows the inkjet head 11 to eject ink onto a sheet which is transferred by the transfer unit 4 on the basis of the print job. Thereby, an image is printed on the sheet.

When the amount of ink in the ink circulation unit 12 is reduced by being used for printing, the controller 5 controls the ink replenishment unit 13 so as to replenish ink. Specifically, when the liquid surface of the ink tank 21 is lowered due to a reduction in ink in the ink circulation unit 12 and the liquid surface sensor 29 is turned off, the controller 5 opens the ink replenishment valve 37. Thereby, the ink in the ink cartridge 36 is supplied into the ink tank 21. When the ink is supplied, the liquid surface of the ink tank 21 goes up and the liquid surface sensor 29 is turned on, the controller 5 closes the ink replenishment valve 37.

In addition, when the inkjet head 11 performs an ejecting operation while the ink circulating operation is being performed, heat is generated from the inkjet head 11 and the temperature of the ink is increased by being influenced by heat generation. Against temperature rising, the controller 5 controls the ink temperature regulator 25 to regulate the ink temperature so that a temperature detected by the ink temperature sensor 26 does not deviate from a print-allowable temperature range of the inkjet head 11.

A fluctuation in ink temperature $T_i$ arises due to driving of the inkjet head 11 and temperature regulation by the ink temperature regulator 25 while the ink circulating operation is being performed as mentioned above. Against the fluctuation in temperature, the controller 5 regulates the pressure in the ink tank 21 and the driving rate of the ink pump 24 in accordance with the fluctuation in ink temperature $T_i$ still while the ink circulating operation is being performed.

Specifically, after the ink circulating operation has been started, in step S6, the controller 5 determines whether or not an ink temperature acquisition timing has come. The ink temperature acquisition timing is set at a predetermined time interval after the ink circulating operation has been started.

When it is determined that the ink temperature acquisition timing has come (step S6: YES), the controller 5 proceeds to step S7. Processing in steps S7, S8 and S9 is the same as the processing in steps S2, S3 and S4.

Following step S9, in step S10, the controller 5 controls the pressure regulator 3 to regulate the pressure in the ink tank 21 to the set negative pressure $P_f$ which has been determined in step S8. At the same time, the controller 5 changes the driving rate of the ink pump 24 to the driving rate which has been determined in step S9.

Here, regulation of the pressure in the ink tank 21 is performed by the air pump 42 or the pressure regulating valve 44. Specifically, when the pressure of the ink tank 21 is to be reduced, the controller 5 drives the air pump 42. Thereby, air is sucked from the common air chamber 41 and the pressure in the ink tank 21 is reduced together with pressure reduction in the common air chamber 41. While, when the pressure in the ink tank 21 is to be increased, the controller 5 opens the pressure regulating valve 44. Thereby, air flows into the common air chamber 41 and the pressure in the ink tank 21 is increased together with pressure increase in the common air chamber 41.

After step S10, the controller 5 returns to step S6.

In step S6, when it is determined that the ink temperature acquisition timing has not yet come (step S6: NO), in step S11, the controller 5 determines whether or not the print job has been terminated. When it is determined that the print job has not yet been terminated (step S11: NO), the controller 5 returns to step S6.

When it is determined that the print job has been terminated (step S11: YES), in step S12, the controller 5 terminates the ink circulating operation. Specifically, the controller 5 opens the atmospheric air open valve 43 and stops the ink pump 24. Thereby, the inkjet printing device 1 stops the operation and enters a standby state.

As described above, in the inkjet printing device 1, the controller 5 regulates the pressure in the ink tank 21 and the driving rate of the ink pump 24 in accordance with the ink temperature $T_i$ of each printer 2. Specifically, the controller 5 determines the set negative pressure $P_f$ in the ink tank 21 on the basis of the ink temperature $T_i$ of each printer 2 and determines the necessary circulation flow rate $Q_n$ of ink according to the set negative pressure $P_f$, the ink temperature $T_i$ and the specified nozzle pressure $P_n$ for every printer 2. In addition, the controller 5 determines the driving rate of the ink pump 24 according to the set negative pressure $P_f$, the ink temperature $T_i$ and the necessary circulation flow rate $Q_n$ for every printer 2. Then, the controller 5 regulates the pressure in each ink tank 21 to the set negative pressure $P_f$ by the pressure regulator 3 and drives the ink pump 24 at the driving rate which has been determined for every printer 2.

Thereby, it becomes possible for the inkjet printing device 1 to suppress the fluctuation in circulation flow rate of ink and the fluctuation in nozzle pressure according to the fluctuation in ink temperature $T_i$ in each printer 2. Consequently, it is possible to suppress deterioration of printed image quality while suppressing the load on the ink pump 24 of each printer 2. In addition, since use of the ink pump 24 of high performance is not necessary, it is possible to avoid an increase in size of the device.

Although in the above-mentioned embodiment, description has been made in regard to the inkjet printing device 1 including the four printers 2, the number of the printers 2 is not limited to four. The present invention is also applicable to the case of using one printer 2.

In case of a configuration of one printer 2, the standard negative pressure $P_t$ of the ink tank 21 at the ink temperature $T_i$ of the printer 2 concerned may be set as the set negative pressure $P_f$. In addition, the driving rate of the ink pump 24 may be calculated by setting the minimum required flow rate $Q_{min}$ as the necessary circulation flow rate $Q_n$ and the ink pump 24 may be driven at the calculated driving rate.

Even in case of the configuration of one printer 2, it is possible to suppress the fluctuation in circulation flow rate of ink and the fluctuation in nozzle pressure according to the fluctuation in ink temperature $T_i$ by regulating the pressure in the ink tank 21 and the driving rate of the ink pump 24 in accordance with the ink temperature $T_i$ of the printer 2 concerned in this way. Thereby, it is possible to suppress deterioration of printed image quality while suppressing the load on the ink pump 24.

As the air pump 42, a pump of the type which is inversely rotatable may be also used. In this case, also pressure application to the ink tank 21 becomes possible by the air pump 42. Therefore, it is possible to eliminate the pressure regulating valve 44 and the air conduit 49.

While embodiments of the present invention have been described hereinabove, these embodiments are merely illustration described for the purpose of facilitating the understanding of the present invention, and the present invention is not limited to the embodiments. The technical scope of the present invention is not limited to the specific technical matters disclosed in the embodiments but includes various modifications, changes, alternative techniques, and the like which can readily be conceived therefrom.

The entire content of Japanese Patent Application No. 2014-168226 (filed on Aug. 21, 2014) is incorporated herein by reference.

INDUSTRIAL APPLICABILITY

In the inkjet printing device according to the embodiment of the present invention, it is possible to suppress the fluctuation in circulation flow rate of ink and the fluctuation in nozzle pressure according to the fluctuation in ink temperature by regulating the pressure in the ink tank and the driving rate of the ink pump in accordance with the ink temperature of the printer concerned. Thereby, it is possible to suppress deterioration of printed image quality while suppressing the load on the ink pump.

What is claimed is:

1. An inkjet printing device, comprising:

a printer, including an inkjet head having a nozzle configured to eject ink, an ink tank configured to store the ink, a circulation path configured to circulate the ink between the ink tank and the inkjet head, an ink pump configured to send the ink from the ink tank to the inkjet head in order to circulate the ink, and an ink temperature sensor configured to detect an ink temperature;

a pressure regulator configured to apply a negative pressure to the ink tank and to regulate a pressure in the ink tank; and a controller configured to set a set pressure for the ink tank on the basis of the ink temperature in the printer, to control the pressure regulator to regulate the pressure in the ink tank, and to regulate a driving rate of the ink pump in accordance with the set pressure for the ink tank.

2. The inkjet printing device according to claim 1, wherein the pressure regulator is used in common for the printer and another printer, and the controller determines a circulation amount of ink according to the set pressure, the ink temperature and a specified nozzle pressure for each of the printer and the another printer, and controls the pressure regulator to regulate the pressure in the ink tank of each of the-printer and the another printer to the set pressure and to drive the ink pump at the driving rate according to the set pressure, the ink temperature and the circulation amount for each of the printer and the another printer.

3. The inkjet printing device according to claim 1, wherein the controller calculates a flow rate of ink according to the set pressure.

4. The inkjet printing device according to claim 1, wherein the controller controls the pressure regulator to maintain the set pressure.

* * * * *